US008567140B2

(12) United States Patent
Wagner

(10) Patent No.: US 8,567,140 B2
(45) Date of Patent: Oct. 29, 2013

(54) FAçADE CONSTRUCTION

(75) Inventor: Rudolf Wagner, Straubing (DE)

(73) Assignee: Moeding Keramikfassaden GmbH (DE)

( * ) Notice: Subject to any disclaimer, the term of this patent is extended or adjusted under 35 U.S.C. 154(b) by 324 days.

(21) Appl. No.: 12/618,133

(22) Filed: Nov. 13, 2009

(65) Prior Publication Data

US 2010/0154336 A1 Jun. 24, 2010

(30) Foreign Application Priority Data

Nov. 13, 2008 (DE) ..... 10 2008 056 970

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04C 2/38*** | (2006.01) |
| ***E04B 2/00*** | (2006.01) |
| ***E04B 5/00*** | (2006.01) |

(52) U.S. Cl.
USPC ..... 52/235; 52/475.1; 52/506.06; 52/506.08

(58) Field of Classification Search
USPC ..... 52/235, 384, 385, 475.1, 483.1, 489.1, 52/489.2, 506.01, 506.05, 506.06, 506.08
See application file for complete search history.

(56) References Cited

U.S. PATENT DOCUMENTS

| | | | | |
|---|---|---|---|---|
| 5,265,396 | A * | 11/1993 | Amimoto | 52/745.12 |
| 5,860,257 | A * | 1/1999 | Gerhaher et al. | 52/235 |
| 6,098,364 | A * | 8/2000 | Liu | 52/506.08 |
| 2002/0023398 | A1 * | 2/2002 | Ito | 52/220.1 |
| 2004/0079038 | A1 * | 4/2004 | Crooker, Jr. | 52/235 |
| 2005/0060950 | A1 * | 3/2005 | Hauschildt et al. | 52/235 |
| 2005/0279037 | A1 * | 12/2005 | Overgaard | 52/287.1 |

(Continued)

FOREIGN PATENT DOCUMENTS

| | | | | |
|---|---|---|---|---|
| DE | 1289289 | B | 2/1969 | |
| DE | 3201772 | A1 | 9/1982 | |
| DE | 20014707 | U1 | 10/2000 | |
| EP | 1182306 | A2 * | 2/2002 | E04F 13/08 |

OTHER PUBLICATIONS

Translation of EP 1182306A2. Sep. 25, 2011.*

(Continued)

*Primary Examiner* — Joshua J Michener
*Assistant Examiner* — Ryan Kwiecinski
(74) *Attorney, Agent, or Firm* — Lerner, David, Littenberg, Krumholz & Mentlik, LLP

(57) ABSTRACT

Such a substructure has vertically and horizontally running profiles which are fastened on a masonrywork wall, cross over one another and have holes. So that there is no need for dimensionally accurate installation, or for holes to be drilled into the profiles at the building site, in order to avoid displacement of a profile when the connection between the profiles is being loosened, both the vertically and the horizontally running profiles have slots, wherein the slots of the vertically running profile cross over the slots of the horizontally running profile, and at least one of the profiles has a channel-like cross section, it being possible for a plate which has a slot to be inserted into the channel, and fixed, at the crossover point of the profiles, the slot of said plate crossing over the slots of the vertically and of the horizontally running profiles and it being possible for the plate to be locked to the profiles by means of a locking component which passes through the crossing-over slots.

14 Claims, 6 Drawing Sheets

(56) References Cited

U.S. PATENT DOCUMENTS

| | | | | |
|---|---|---|---|---|
| 2007/0022682 | A1* | 2/2007 | Morgenegg et al. | 52/235 |
| 2008/0010922 | A1* | 1/2008 | Wagner | 52/235 |
| 2010/0154336 | A1* | 6/2010 | Wagner | 52/235 |
| 2012/0151861 | A1* | 6/2012 | Mulhair | 52/506.05 |

OTHER PUBLICATIONS

Office Action dated Jul. 31, 2009 from corresponding German Application 102008056970.4-25 citing EP 1182306.

European Search Report, EP 09014200, dated Jan. 26, 2011.

* cited by examiner

FAçADE CONSTRUCTION

BACKGROUND OF THE INVENTION

The invention relates to a façade structure according to the preamble of Claim 1.

Façade structures with a sub-structure formed from vertical and/or horizontal profiled supports are known, said sub-structure being located in front of a building wall or being anchored in a fixed manner in the ground or in the building wall. Façade panels made from ceramic material, preferably clay material, are secured to the sub-structure via panel holders.

The panel holders, as a rule, are H-shaped in cross section, that means they have an upwardly open U-shaped section receiving means and a downwardly open U-shaped section receiving means. The façade panels are inserted into the panel holders such that they engage in the upwardly open U-shaped receiving means with their foot fold and in the downwardly open U-shaped receiving means of the panel holder with their head fold.

It is known that the H-shaped panel holders are secured in the vertical profiled supports by means of screws. As a rule, the vertical profiled supports are realized as T-sections. Their rear flange faces the building wall and there is secured via corresponding supports to horizontal profiled supports of the sub-structure or directly to the wall. The front T-shaped flange is for screw-connecting the panel holders. To date there are three systems in practice in conjunction with the screw-fastening. In the one case, the securing flange of the T-section is unpunched. The panel holder is secured in the respectively selected position by means of drilling on site. In the other case, securing holes are already located in the securing flange in a grid arrangement in a vertical row of holes. This means that it is not possible to adjust the position of the panel holder in a stepless manner but simply within the grid spacing of the row of holes. In the case of the third system, an undercut false channel for the panel holders is realized on the front side of the securing flange of the vertical T-section. For securement, it is also necessary in this case for the securing hole to be drilled on site. The panel holder has to be threaded into the undercut false channel in each case from the upper or from the lower end, which makes the assembly more difficult.

SUMMARY OF THE INVENTION

It is the object of the present invention to provide an improved façade structure, making simple securement and alignment of the panel holder possible.

This object is achieved according to the invention with the object of Claim 1. Proposed is a façade structure, preferably a curtained, rear-ventilated façade structure, having a sub-structure that is formed from vertical and/or horizontal profiled supports, is located in front of a building wall and/or is anchored in a fixed manner in the ground or in the building wall, having façade panels made of ceramic material, preferably clay material, that are secured to the sub-structure via panel holders. The panel holders each have on their front side at least one receiving means for a lower edge, preferably a foot fold of a façade panel, or for an upper edge, preferably a head fold of a façade panel, and at their rear side a securing flange for securement to the sub-structure. It is provided in this case that, for securing the panel holder to the sub-structure, the sub-structure has a vertical flange, in which a vertical row of holes is realized by a plurality of elongated holes located one above another, wherein the elongated holes each extend in an angled manner, preferably at an acute angle to the horizontal, and are located in a parallel or angled manner one relative to another, and the row of holes is located between two parallel extending guide ribs, which protrude forward from the vertical flange. It is additionally provided in this case that the securing flange of the panel holder is insertable in an engaging manner between the guide ribs and has at least one elongated hole, which extends at an angle to the horizontal that is not identical to the angle of a plurality of elongated holes, preferably of all the elongated holes of the row of elongated holes realized in the vertical flange of the sub-structure, such that the elongated hole in the securing flange of the panel holder intersects at least one of the elongated holes of the row of holes of the vertical flange of the sub-structure. It is provided in this case that, for securing the securing flange of the panel holder to the front flange of the sub-structure, a securing element is insertable and/or securable in the intersection region of the elongated holes.

It is essential to the invention that one or more vertical rows of holes are located in the vertical profiled support of the sub-structure, said rows of holes each comprising elongated holes that extend inclinedly in parallel. If said elongated holes are located inversely to the elongated hole in the securing flange of the panel holder, it is possible to adjust the intersection point with the elongate hole of the vertical profiled support of the panel holder over the entire vertical region of each elongated hole of the vertical profiled support by the panel holder being displaceable in its vertical position as long as the securing element is not yet inserted. When the panel holder is displaced in this manner, the intersection point of the two elongated holes moves up or down in the elongated hole of the vertical section. As soon as the securing element is inserted, the intersection point is fixed. The panel holders are therefore secured to the vertical profiled supports of the fixed sub-structure in this manner.

In the case of the present invention, the position of the panel holder can be adjusted steplessly at least in a sectional manner and it is also not necessary to drill on site. Securement can be effected by means of an arbitrary securing element that is simply inserted into the respective intersection point of the elongated holes. As described above, the vertical position of the intersection point can be adjusted steplessly by vertical displacement of the panel holder guided between the guide ribs before the securing element is inserted. Once the securing element has been inserted, the position of the panel holder is fixed.

Consequently, a substantial advantage of preferred exemplary embodiments of the invention is in the, at least in sections, stepless adjustability of the vertical position and of the securement of the panel holders. A rivet is preferably used for securing the panel holder on the profiled support. A rivet gun is used as the tool for mounting the rivet. However, it is also possible to use a screw, preferably self-tapping, to secure the panel holder. A cordless screwdriver is preferably used as the tool for this purpose.

It can be provided that the angle of the elongated hole in the securing flange of the panel holder is realized inversely to the angle of the elongated holes of the row of holes in the vertical flange of the sub-structure.

In an advantageous embodiment it can be provided that the angle of the elongated holes of the row of holes in the vertical flange of the sub-structure is +45° or −45° to the horizontal and/or that the angle of the elongated hole in the securing flange of the panel holder is −45° or +45° to the horizontal.

It can also be provided that the elongated holes of the row of holes in the vertical flange of the sub-structure are located in a grid arrangement.

It is also possible that the elongated holes of the row of holes in the vertical flange of the sub-structure cover a vertical section of the vertical flange of the sub-structure, said section being equal to the grid spacing or smaller than the grid spacing of the elongated holes.

The grid spacing can preferably be smaller or equal to the sum of the width of the elongated hole and the quotient from the grid spacing and double the sine of the width of the elongated hole. In this case, the panel holder can be mounted at any arbitrary vertical position on the sub-structure.

It can be provided that the securing element is realized as a securing screw or securing pin, for example a bolt, rivet or screw. The securing element is preferably realized such that a press-type and/or clamp-type connection is realized in the point of intersection of the elongated holes and the securing flange of the panel holder is pressed against the vertical flange of the sub-structure such that the securing flange of the panel holder and the vertical flange are each held together between two stop members. A rivet is preferably used as the securing element, however, self-tapping screws can also be used in an advantageous manner. In principle, it is also possible to use screws with nuts.

In addition it can be provided that the width of the elongated hole of the securing flange of the panel holder is equal to the width of the elongated hole of the row of holes in the vertical flange of the sub-structure and said width corresponds to the diameter of the securing element. It is assumed here that nominal sizes are used in each case and that a clearance fit is realized between the nominal sizes so that the securing element is insertable without the aid of a tool, for example a hammer.

BRIEF DESCRIPTION OF THE DRAWINGS

The invention is now described by way of exemplary embodiments, in which, in detail

DETAILED DESCRIPTION OF THE INVENTION

Figure 1:
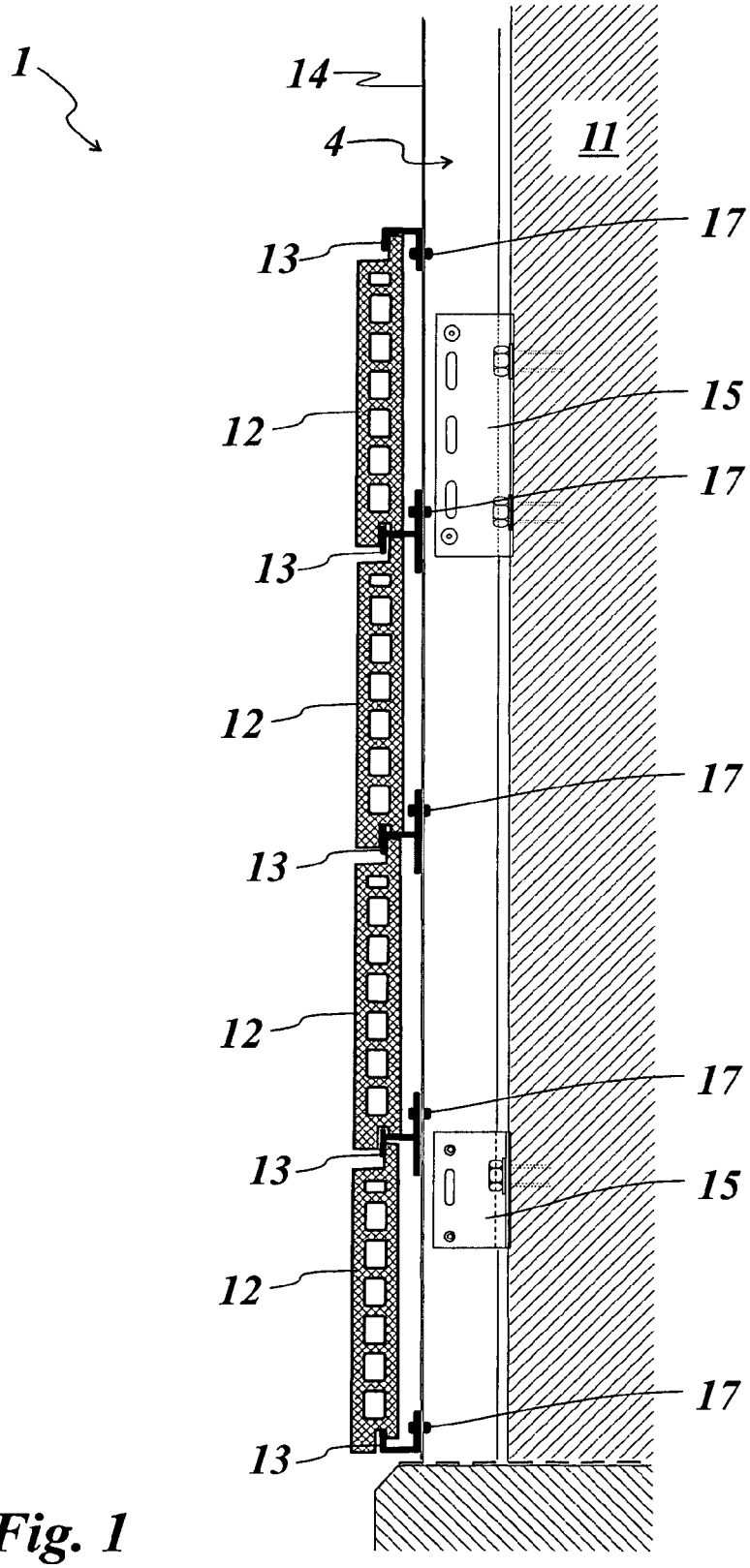
FIG. 1 shows a schematic representation of a façade structure according to the invention.
Figure 6:
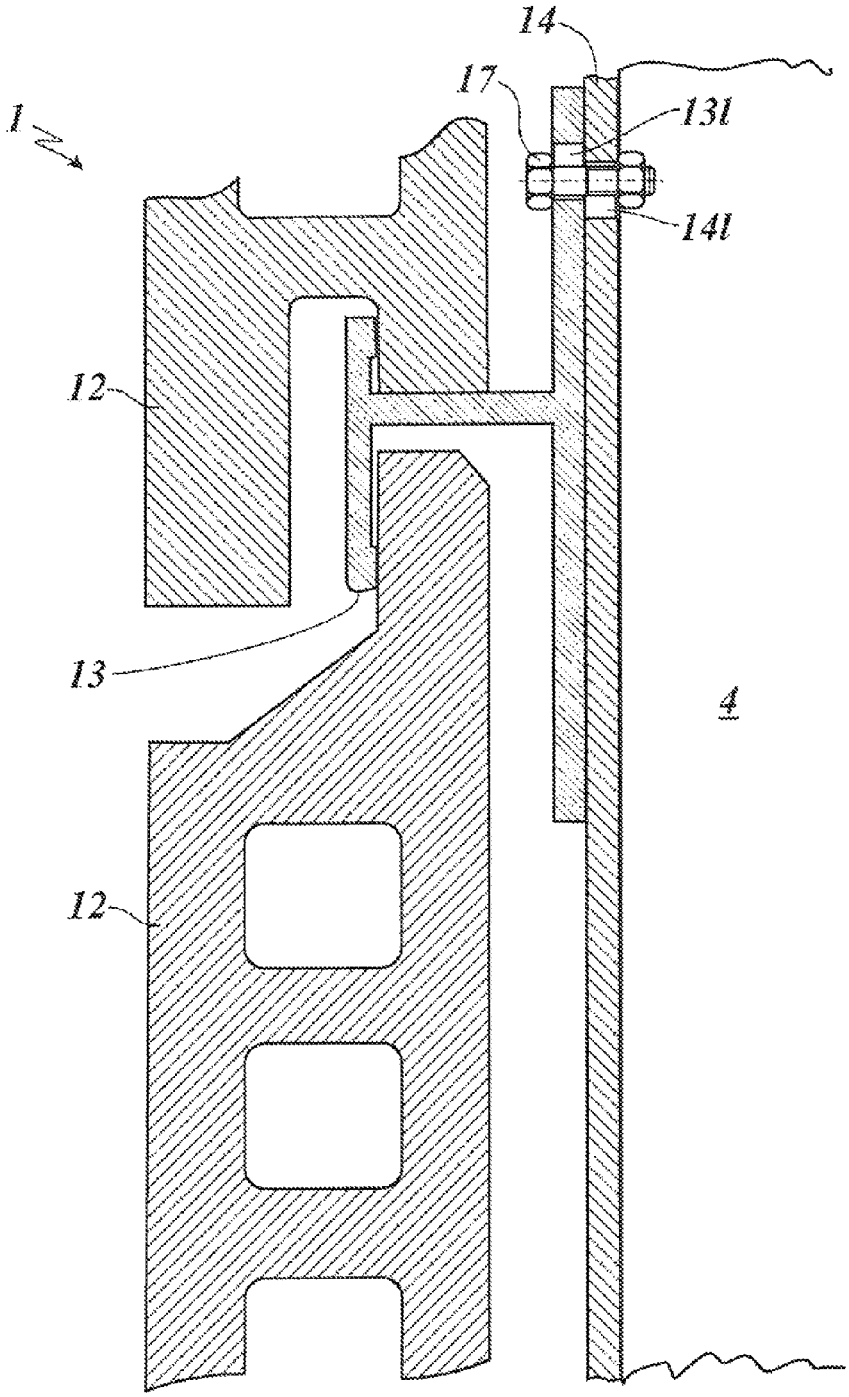
FIG. 6 shows a schematic representation of a facade structure according to the invention.
Figures 7, 8:
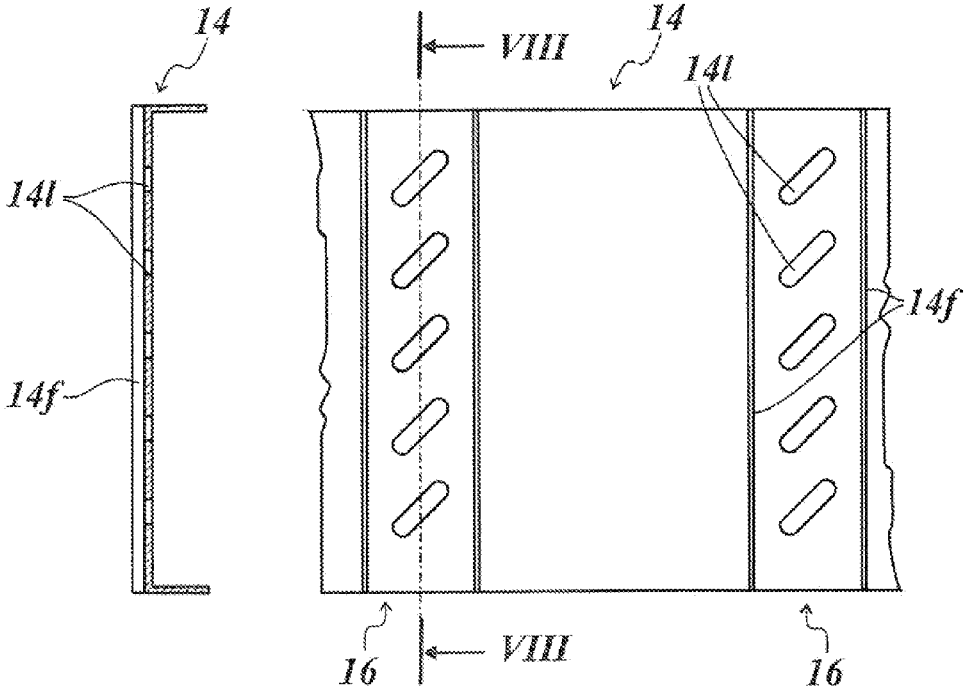
FIG. 7 shows the front view of a horizontal flange of the sub-structure of the facade structure in FIG. 6.
FIG. 8 shows a sectional view of the flange along the line of intersection VIII-VIII in FIG. 7.
Figure 9:
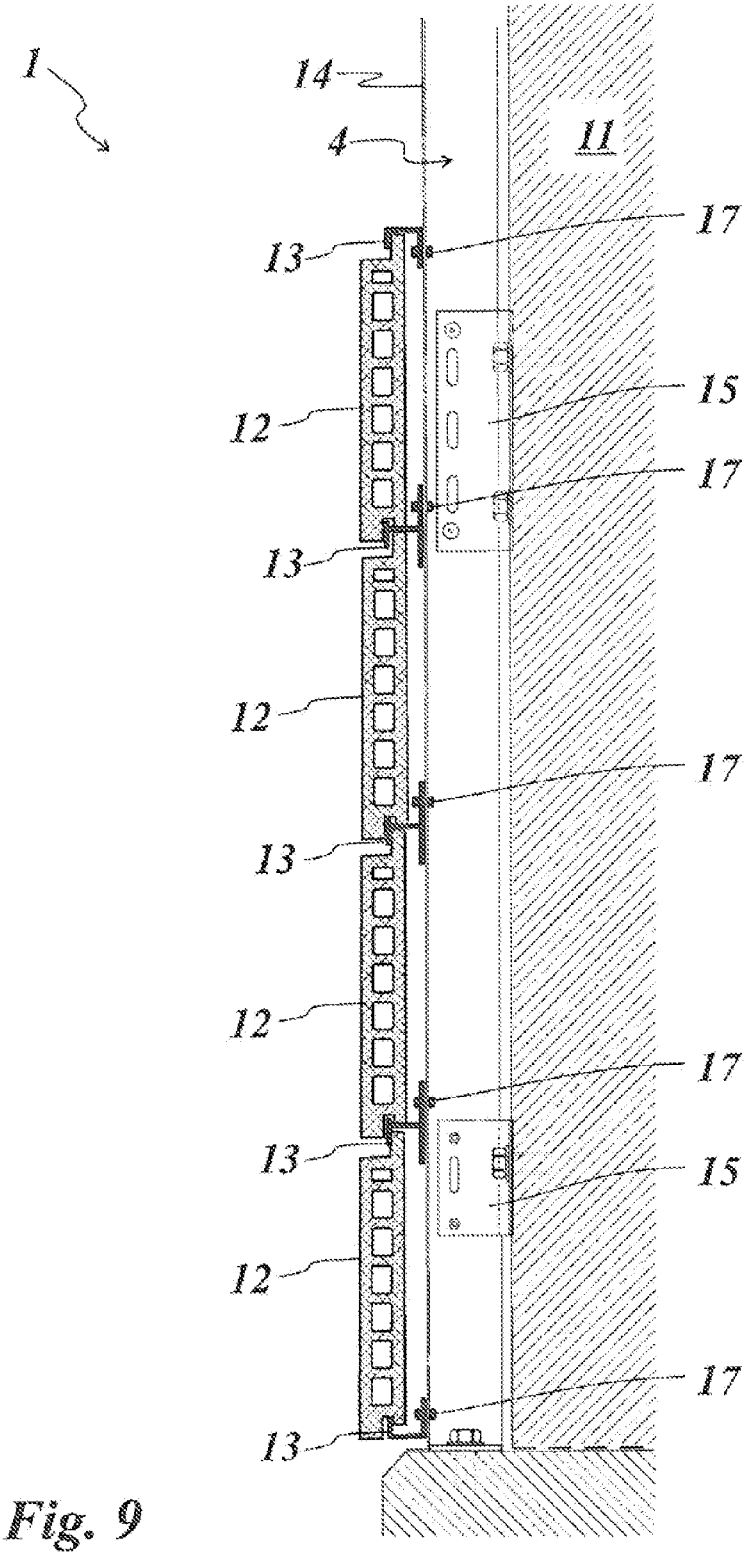
FIG. 9 shows a schematic representation of a facade structure according to the invention.

FIGS. 1, 6 and 9 show a facade structure 1 with facade panels 12 located on a sub-structure on a building wall 11, which may be anchored in a fixed manner in the ground or the building wall 11. The sub-structure is formed from vertical (see FIG. 1) or horizontal (see FIGS. 7 and 8) profiled supports 4 that are secured to the building wall 11. The building wall 11 is preferably an exterior wall of a building. The facade panels 12 are suspended on panel holders 13 that are secured to the vertical or horizontal profiled supports 4. The facade panels 12 form rows located one above another in front of the building wall 11. The vertical or horizontal profiled supports 4 are connected to the building wall 11 via mounting brackets 15.

Figure 2:
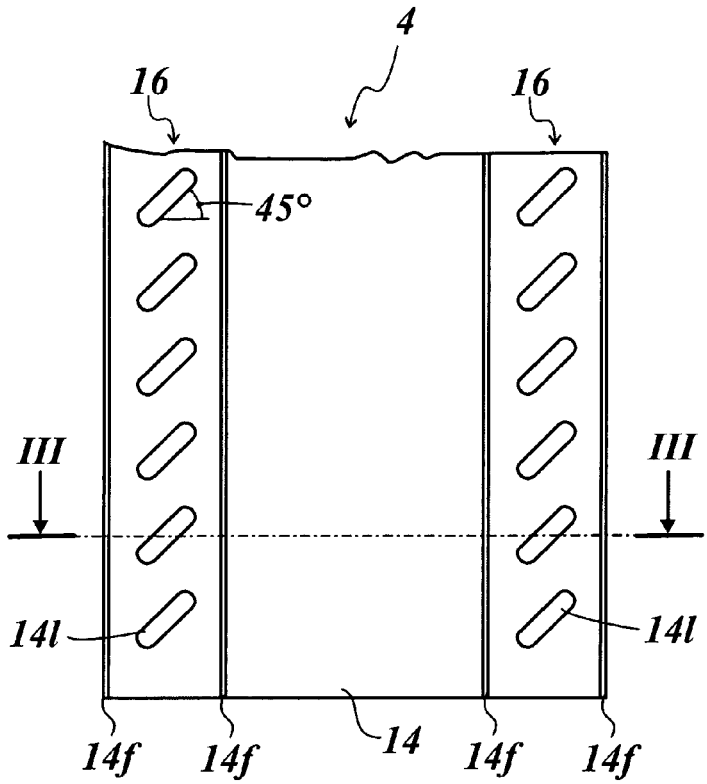
FIG. 2 shows the front view of a vertical flange of the sub-structure of the façade structure in FIG. 1.
Figure 3:
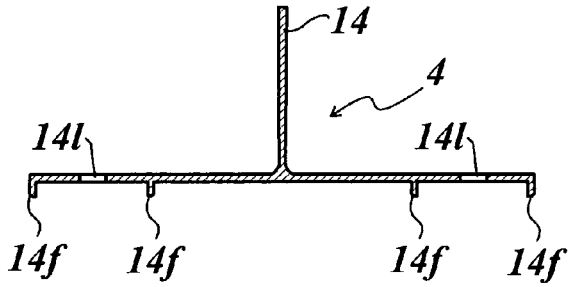
FIG. 3 shows a sectional view of the flange along the line of intersection III-III in FIG. 2.

The vertical profiled support 4 in the represented exemplary embodiment is a T-section beam. As can be seen in FIG. 2, in the vertical flange 14 that is realized as front T-flange, there are two vertical rows of holes 16 made of elongated holes 141, in each case between two protruding guide ribs 14*f*, which are provided for securing the panel holders 13. This means that it is possible to secure the panel holders 13 respectively on the left side and on the right side in each vertical profiled support on the front flange 14. The panel holders 13 are each located in pairs in each vertical position in order, in each case, to hold adjacent facade panels 12. The panel holders 13 in the case represented in FIG. 4 are each realized as H-section beams as for conventional panel holders. They form an upwardly open U and a downwardly open U for receiving the foot or head fold of the facade panels 12, such as shown in FIG. 6. An inclinedly extending elongated hole 131 for securement in the elongated holes 141 of the vertical flange is realized in the rear flange, the securing flange. The elongated hole 131 is inclined at an angle of 45° to the horizontal.

Figure 4A:
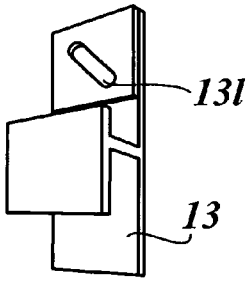
FIG. 4*a* shows a three-dimensional schematic representation of a panel holder of the façade structure in FIG. 1.
Figure 4B:
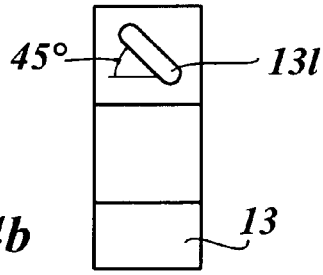
FIG. 4*b* shows a schematic front view of the panel holder in FIG. 4*a;*

In the exemplary embodiment represented in FIG. 2, the elongated holes 141 of the rows of holes of the vertical flange 14 each extend at an angle of 45° to the horizontal. As can be seen in FIGS. 4*a* and 4*b*, the elongated hole 131 extends in the panel holder 13 in an inverse manner, but also at an angle of 45° to the horizontal. The panel holders 13 are secured on the vertical flange 14 by securing elements 17, which pass through the elongated holes 131 and 141 each located one behind another in the facade structure 1. In the case of the exemplary embodiment represented, spacing of the elongated holes in the row of holes of the vertical flange is 24 mm. In the grid elongated the case represented, the elongated holes do not extend over the entire grid spacing in each case, but a spacing of 8.3 mm between the upper edge of the lower elongated hole and the lower edge of the upper elongated hole remains in each case between adjacent elongated holes, so that an adjustment step is produced in this region not covered by the elongated hole. However, it is also possible to select the grid spacing and the dimensions of the elongated holes such that adjustment steps are avoided. To this end, the grid spacing can be smaller or equal to the sum of the width of the elongated hole and the quotient of the grid spacing and double the sine of the width of the elongated hole. In this case, the panel holder can be mounted in any arbitrary vertical position on the sub-structure.

Figure 5B:
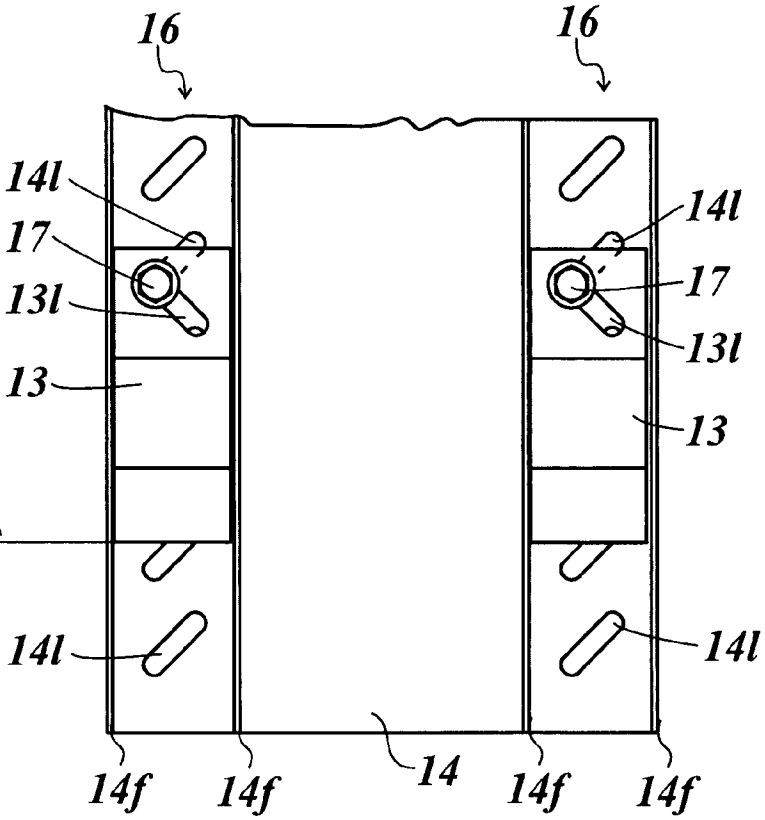
FIG. 5*b* shows the vertical flange in FIG. 2 with mounted panel holders in a second mounting position.
Figure 5A:
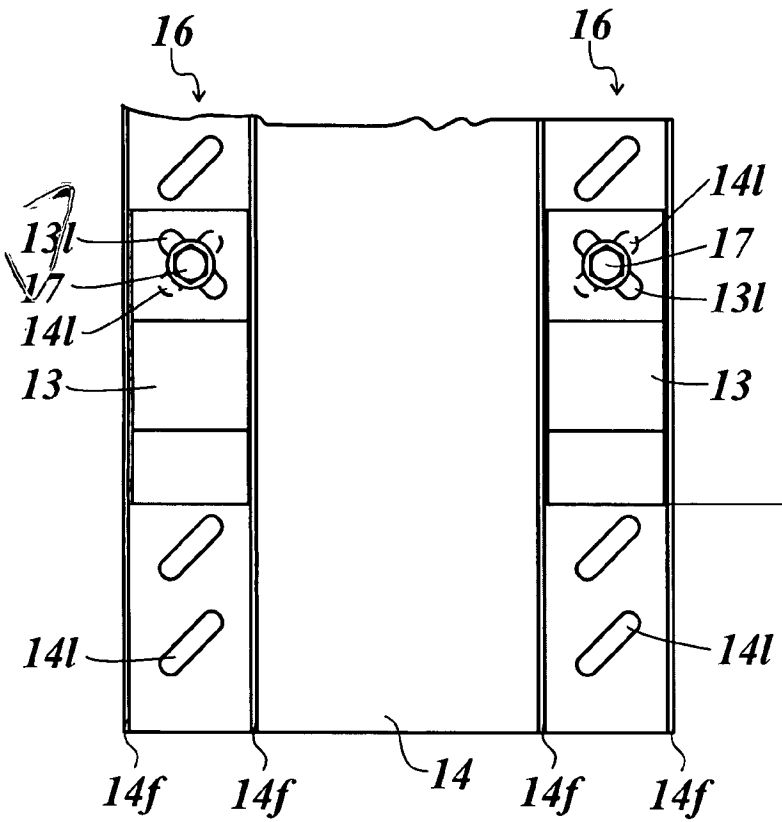
FIG. 5*a* shows the vertical flange in FIG. 2 with mounted panel holders in a first mounting position.

FIGS. 5*a* and 5*b* show the vertical flange 14 in FIG. 2 with panel holders 13 mounted in different mounting positions.

In the mounting position represented in FIG. 5*a*, the elongated holes 13*l* and 14*l* intersect in the centre so that the securing element 17 also assumes a central position. In the mounting position represented in FIG. 5*b*, the two panel holders 13 are moved further down by a spacing Δ, the securing element passing in an eccentric manner through the elongated holes 13*l* and 14*l*, which no longer intersect centrally. A cylinder head screw is provided as the securing element 17 in the exemplary embodiment represented in FIGS. 5*a* and 5*b*. Said cylinder head screw can be screw-connected to a nut in order to obtain a secure connection between the panel holder 13 and the vertical flange 14. A self-tapping screw or a rivet can also be used in place of the cylinder head screw with nut to secure the panel holder on the profiled support. Mounting advantages are produced when rivets and self-tapping screws are used.

LIST OF REFERENCES

1 Façade structure
4 Vertical profiled support
11 Building wall
12 Façade panel
13 Panel holder
14 Vertical flange
**14*f*** Guide rib
**14*l*** Elongated hole
15 Securing bracket
16 Row of holes
17 Securing element

The invention claimed is:

1. Façade structure comprising:

a sub-structure that is formed from at least one of vertical or horizontal profiled supports, and adapted to be at least one of located in front of a building wall or anchored in a fixed manner in the ground or in the building wall;

façade panels made of ceramic material that are secured to the sub-structure via at least one panel holder, wherein the panel holder has on a front side at least one receiving means for a lower edge or for an upper edge of the façade panels, and at a rear side a securing flange for securement to the sub-structure, wherein for securing the panel holder to the sub-structure, the sub-structure has a vertical flange, in which a vertical row of holes comprises a plurality of elongated holes located one above another, wherein each of the plurality of elongated holes of the row of holes of the vertical flange of the sub-structure extends at an angle in relation to a horizontal direction of the sub-structure and is located in a parallel manner one relative to another, and the row of holes is located between two parallel vertically extending guide ribs, which protrude forward from the vertical flange;

wherein the securing flange of the panel holder has at least one elongated hole, and wherein the securing flange of the panel holder is inserted in an engaging manner between the guide ribs so the guide ribs secure the securing flange of the panel holder and the at least one elongated hole extends at an angle in relation to the horizontal direction that is in a direction opposite to a direction that the angle of the plurality of the elongated holes of the row of holes of the vertical flange of the sub-structure extends, such that the at least one elongated hole in the securing flange of the panel holder intersects at least one of the plurality of elongated holes of the row of holes of the vertical flange of the sub-structure, the securing flange of the panel holder is secured to the vertical flange of the sub-structure by a securing element inserted in an intersection region of the at least one elongated hole of the securing flange of the panel holder and the at least one of the plurality of elongated holes of the row of holes of the vertical flange of the sub-structure, and the securing flange of the panel holder is only displaceable vertically relative to the sub-structure.

2. Façade structure according to claim 1, wherein, with the securing flange inserted in the engaging manner between the guide ribs, the angle of the at least one elongated hole in the securing flange of the panel holder extends inversely to the angle of the plurality of elongated holes of the row of holes in the vertical flange of the sub-structure.

3. Façade structure according to claim 2, wherein, with the securing flange inserted in the engaging manner between the guide ribs, at least one of the angle of the plurality of elongated holes of the row of holes in the vertical flange of the sub-structure is +45° or −45° to the horizontal direction or the angle of the at least one elongated hole in the securing flange of the panel holder is −45° or +45° to the horizontal direction.

4. Façade structure according to claim 1, characterized in that the plurality of elongated holes of the row of holes in the vertical flange of the sub-structure is in a grid arrangement.

5. Façade structure according to claim 4, characterized in that the plurality of elongated holes of the row of holes in the vertical flange of the sub-structure covers a vertical section of the vertical flange of the sub-structure, said section being equal to or smaller than a grid spacing of the plurality of elongated holes of the row of holes in the vertical flange of the sub-structure.

6. Façade structure according to claim 1, characterized in that the securing element is a securing screw or securing pin.

7. Façade structure according to claim 6, wherein the securing element is a bolt, rivet or screw.

8. Façade structure according to claim 1, characterized in that the at least one elongated hole of the securing flange of the panel holder has a width equal to a width of the plurality of elongated holes of the row of holes in the vertical flange of the sub-structure and corresponding to a diameter of the securing element.

9. Façade structure according to claim 1, wherein the façade structure is a curtained, rear-ventilated façade structure.

10. Façade structure according to claim 1, wherein the ceramic material includes clay material.

11. Façade structure according to claim 1, wherein the lower edge is a foot fold of a façade panel.

12. Façade structure according to claim 1, wherein the upper edge is a head fold of a façade panel.

13. Façade structure according to claim 1, wherein each of the plurality of elongated holes of the row of holes in the vertical flange of the sub-structure extends at an acute angle to the horizontal direction.

14. Façade structure according to claim 1, wherein, with the securing flange inserted in the engaging manner between the guide ribs, the at least one elongated hole of the panel holder extends at an angle to the horizontal direction that is not identical to an angle of all of a plurality of elongated holes forming the row of holes in the vertical flange of the sub-structure.

* * * * *